US005160602A

United States Patent [19]

Becraft et al.

[11] Patent Number: 5,160,602

[45] Date of Patent: Nov. 3, 1992

[54] PROCESS FOR PRODUCING ISOTROPIC COKE

[75] Inventors: Lloyd G. Becraft; Edward J. Nanni, both of Ponca City, Okla.

[73] Assignee: Conoco Inc., Ponca City, Okla.

[21] Appl. No.: 766,998

[22] Filed: Sep. 27, 1991

[51] Int. Cl.[5] ..... C10G 9/14

[52] U.S. Cl. ..... 208/131; 208/50; 208/125; 208/126

[58] Field of Search ..... 208/131

[56] References Cited

U.S. PATENT DOCUMENTS

| | | | |
|---|---|---|---|
| 3,960,704 | 6/1976 | Kegler et al. | 208/131 |
| 4,049,538 | 9/1977 | Hayashi et al. | 208/131 |
| 4,108,798 | 8/1978 | Sze et al. | 208/131 |
| 4,312,745 | 1/1982 | Hsu et al. | 208/131 |
| 4,338,137 | 7/1982 | Goodrich | 106/273 R |
| 4,394,250 | 7/1983 | Grossberg | 208/131 |
| 4,466,883 | 8/1984 | Eickemeyer et al. | 208/131 |
| 4,713,168 | 12/1987 | Newmann | 208/131 |
| 4,927,524 | 5/1990 | Rochiguez et al. | 208/131 |
| 4,983,272 | 1/1991 | Stayropoulos | 208/131 |

*Primary Examiner*—Helane Myers

[57] ABSTRACT

A non air-blown low sulfur heavy aromatic mineral oil which does not produce acceptable isotropic coke when subjected to delayed coking is combined with an inorganic additive which promotes pyrolysis and which vaporizes during calcining and the combination is subjected to delayed coking to produce isotropic coke having a low CTE ratio. The isotropic coke is further processed (including calcination) to produce graphite logs used in nuclear reactors.

15 Claims, 1 Drawing Sheet

PROCESS FOR PRODUCING ISOTROPIC COKE

BACKGROUND OF THE INVENTION

Isotropic coke has a thermal expansion approximately equal along the three major crystalline axes. This thermal expansion is normally expressed as CTE (i.e., coefficient of thermal expansion) over a given temperature range such as 30°-530° C. or 30°-100° C. Isotropic coke is also indicated by a CTE ratio, which is 10 the ratio of radial CTE divided by axial CTE measured on a graphitized extruded rod. Acceptable isotropic coke has a CTE ratio of less than about 1.5 or a CTE ratio in the range of about 1.0-1.5.

Isotropic coke is used to produce hexagonal graphite logs which serve as moderators in high temperature gas-cooled nuclear reactors. This type of coke has been produced in the past from natural products such as gilsonite. The production of such graphite logs from gilsonite and the use thereof are described in U.S. patents such as Sturges U.S. Pat. No. 3,231,521 and Martin et al. U.S. Pat. No(s). 3,245,880; and 3,321,375 and to Peterson et al. U.S. Pat. No. 3,112,181 describe the production of isotropic coke using petroleum distillates. Contaminants such as boron, vanadium and sulfur have prohibited the use of some materials as the source of isotropic coke suitable for use in nuclear reactors. Less than about 1.6 weight percent sulfur is preferred to avoid puffing problems upon graphitization and fabrication of the coke. The levels of contaminating elements (sulfur, nitrogen, metals) in many cracked petroleum stocks and sweet resids are sufficiently low to produce a relatively pure carbon product when subjected to delayed coking and calcining, but the products from these raw materials are usually too anisotropic. Sour resids produce cokes which are more isotropic, but they usually are too high in contaminating elements.

One method of producing an acceptable product is to airblow a relatively sweet vacuum resid prior to coking it. This method is described in U.S. Pat. No. 3,960,704 in which a residuum, such as bottoms from the fractionation of virgin feedstocks, is air-blown to increase its softening point. The air-blown resid is then subjected to delayed coking to produce isotropic coke having a CTE ratio less than 1.5.

It would be desirable to provide a process in which petroleum stocks containing low levels of contaminants, which have not been subjected to air-blowing, could be converted to isotropic coke.

THE PRIOR ART

Kegler et al. U.S. Pat. No. 3,960,704 discloses the production of isotropic coke by air-blowing a petroleum residual oil and thereafter subjecting the air-blown oil to delayed coking. The coke is subsequently processed to obtain graphite logs for use as moderators in high temperature, gas-cooled nuclear reactors.

Sze et al. U.S. Pat. No. 4,108,798 discloses delayed coking for production of highly crystalline coke by soaking the feedstock in dissolved sulfur.

Goodrich U.S. Pat. No. 4,338,137 discloses the use of phosphorous sesquisulfide as an asphalt air-blowing catalyst.

Eichemeyer U.S. Pat. No. 4,466,883 discloses the use of sulfur in a feedstock to produce needle coke with superior qualities for the manufacture of graphite artifacts.

Staropoulos U.S. Pat. No. 4,983,272 discloses that sulfur can be added in small quantities to the feedstock for delayed coking.

BRIEF DESCRIPTION OF THE DRAWING

The drawing is a schematic diagram of a process unit which illustrates the process of the invention.

THE INVENTION

Figure 1:
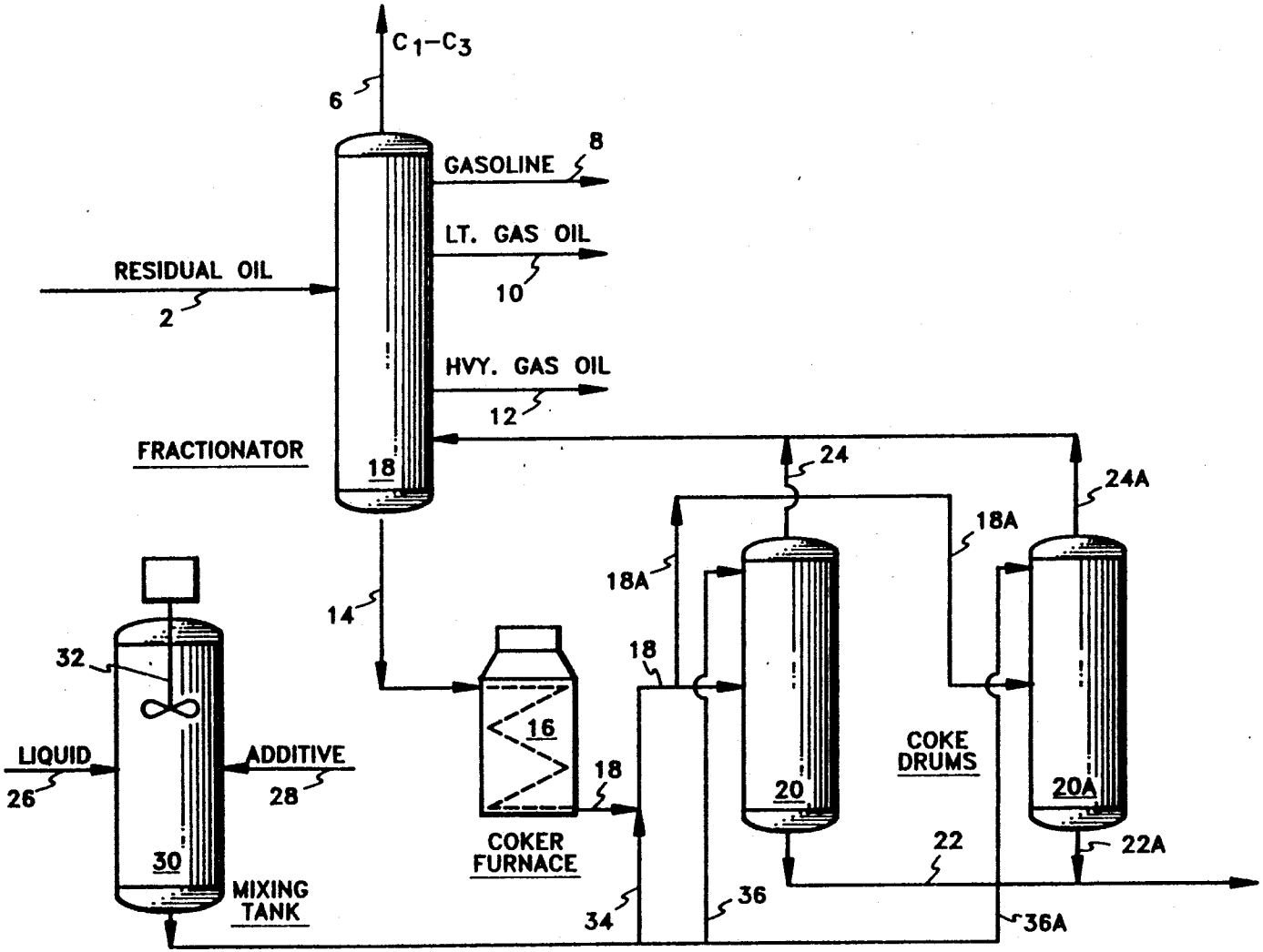

In carrying out the process of the invention, a non air-blown low sulfur, heavy aromatic mineral oil which does not produce acceptable isotropic coke when subjected to delayed coking, is combined with an inorganic additive which promotes pyrolysis and which vaporizes during calcining, and the combination is subjected to delayed coking to produce acceptable isotropic coke which is subsequently subjected to calcining.

DETAILED DESCRIPTION OF THE INVENTION

The fresh feedstocks used in carrying out the process of the invention are low sulfur heavy aromatic mineral oil fractions which have not been air-blown. These feedstocks can be obtained from several sources including petroleum, shale oil, tar sands, coal and the like. Illustrative specific feedstocks include slurry oil, also known as decant oil or clarified oil, which is obtained from fractionating effluent from the catalytic cracking of gas oil and/or residual oils. This material usually has an API gravity ranging from about −5 to about +15 degrees and may have a boiling range of 500° to 900° F. or higher. Another feedstock which may be employed is ethylene or pyrolysis tar. This is a heavy aromatic mineral oil which is derived from the high temperature thermal cracking of mineral oils to produce olefins such as ethylene Pyrolysis tar will have an API gravity varying from about −10 to about +5 and usually has a boiling range of about 600° to about 1200° F. Another feedstock is vacuum resid which is a heavy residual oil obtained from flashing or distilling atmospheric resid, very heavy gas oil or similar material under a vacuum. Vacuum resid usually has a gravity ranging from about 0 to about 15 and boils above about 900° F. Still another feedstock is vacuum gas oil which is a lighter material obtained by flashing or distillation under vacuum. This material usually has a gravity from about 10 to about 30 and a boiling range of about 800° F. to about 1100° F. Thermal tar may also be used as a feedstock. This is a heavy oil which is obtained from fractionation of material produced by thermal cracking of gas oil or similar materials. Thermal tar may have an API gravity from about 8° to about −8° and a boiling range of about 550° to about 850° F. (80%). Still another feedstock is heavy premium coker gas oil which is the heavy oil obtained from liquid products produced in the coking of oils to premium coke. Heavy premium coker gas oil may have an API gravity from about −7 to about 4 and a boiling range from about 500° to about 925° F. (95%). Gas oil from coking operations other than premium coking may also be employed as feedstocks. These other coker gas oils usually have a gravity within the range of about 10 to about 30 and boil between about 600° to about 900° F. Virgin atmospheric gas oil may also be used as a feedstock. This is gas oil produced from the fractionation of crude oil under atmospheric pressure or above. This gas oil may have an API gravity varying from about 20 to about 40 and a boiling range from about 600° to about 850° F. Any of the preceding feedstocks may be used singly or in combination.

As pointed out previously, acceptable isotropic coke preferably contains less than about 1.6 weight percent sulfur. With some aromatic mineral oil feedstocks the sulfur contained in the feedstock is concentrated in the coke product. Thus, the isotropic coke product will contain more sulfur than the starting mineral oil feedstock. This is particularly true when utilizing virgin feedstocks such as virgin residual oil When using this type of feedstock, the mineral oils processed in accordance with the invention are selected from those containing less than about 1.6 weight percent sulfur and preferably not more than about 1.0 weight percent sulfur.

Conversely, with feedstocks which have been thermally or catalytically processed, such as decant oil and pyrolysis tar, the sulfur content of the feedstock may be higher since with these materials, sulfur is not concentrated in the coke product. The coke product may even contain a lower level of sulfur than the starting mineral oil feedstock. When using such materials the sulfur content of the feedstock may be up to 1.6 weight percent or even higher depending on the particular feedstock.

The feedstocks described for use in the process are those which do not alone produce acceptable isotropic coke when subjected to delayed coking. As pointed out previously, acceptable isotropic coke has a coefficient of thermal expansion ratio (CTE ratio) of less than about 1.5. The mineral oil feedstocks used, usually produce an isotropic coke product which has a CTE ratio of 2.0 or higher.

The additives which are combined with the aromatic mineral oil feedstock are inorganic materials which promote pyrolysis and which vaporize during calcining of the isotropic coke product. As described later, calcining is one of the steps used to produce graphite logs from the isotropic coke product. These logs are used as moderators in high temperature gas-cooled nuclear reactors. The preferred additives used in the process are elements selected from groups 4A and 5A of the Periodic Table and sulfides of such elements. Nonlimiting but especially useful elements and compounds are tin (Sn), arsenic (As), phosphorous red (P), lead (Pb), phosphorous sesquisulfide ($P_4S_3$), phosphorous pentasulfide ($P_2S_5$), and arsenic pentasulfide ($As_2S_5$). Any of these additives and any other inorganic additives which promote pyrolysis and which vaporize during calcining may be combined with the mineral oil feedstock in carrying out the process of the invention. Such additives may beutilized either individually or in combination.

Only small amounts of the additive are required to effect the purpose of the invention. Usually the additive is combined with the mineral oil in an amount between about 0.1 and about 5.0 weight percent and preferably between about 0.5 and about 1.0 weight percent. Larger amounts of the additives may be used if desired, but they are not necessary.

The mixture of mineral oil and additive is converted to isotropic coke by subjecting it to delayed coking. The manufacture of coke by delayed coking refers to the formation of coke in a coke drum, such as described in Hackley U.S. Pat. No. 2,922,755. The delayed coking process typically uses petroleum feedstock such as residuum or a mixture of various petroleum fractions to produce petroleum coke.

Referring now to the drawing, a heavy low sulfur aromatic mineral oil, such as an atmospheric residual oil is introduced through line 2 to fractionator 4 where it is combined with overhead vapors from coke drums 20 and 20A. Light gases $C_1$ to $C_3$ are removed overhead from the fractionator through line 6. Heavier materials such as gasoline and light gas oil are taken from the fractionator through lines 8 and 10 respectively. A mixture of residual oil and heavy gas oil is removed form the bottom of fractionator 4 through line 14. The heavy gas oil serves to reduce the viscosity of the residual oil and permit easier handling and pumping of the residual oil to the delayed coking part of the process. A portion of the heavy gas oil which is part of the gaseous effluent from the coke drums is converted to coke in the coking cycle. The amount of such diluent provided in the residual oil may be controlled by varying the amount of heavy gas oil withdrawn from fractionator 4 through line 12.

The mixture of residual oil and heavy gas oil passes through line 14 and is introduced to coker furnace 16 wherein it is heated to temperatures in the range of about 875° to about 975° F. at pressures of about atmospheric to about 250 psig and is then passed via line 18 to coke drums 20 and 20A. The coke drums operate on alternate coking and decoking cycles of about 8 to about 100 hours; while one drum is being filled with coke the other drum is being decoked. During the coking cycle each drum operates at a temperature between about 830° and about 950° F. and a pressure from about 15 to about 200 psig.

The desired additive such as phosphorous sesqui-sulfide is combined through line 34 with hot coker feed leaving the coker furnace 16 through line 18. The combined material is then introduced to either coke drum 20 or coke drum 20A through line 18 or line 18A respectively. Alternatively, the additive may be combined with the heated feed from the coker furnace by introducing it directly into the top of the coke drums 20 and 20A through lines 36 and 36A respectively.

The additive which is customarily in powdered form is prepared for combination with the coker feed by introducing it through line 28 into mixing tank 30. A suitable liquid which may be a portion of the coker furnace feed from fractionator 4 is also introduced through to the mixing tank through line 26. Within mixing tank 30 the two materials are intimately combined by mixing the contents with a powered mixer 32. The liquid containing additive is withdrawn from mixing tank 30 through line 34 and combined with the coker feed as previously described.

Liquids other than the coker feed may be used in mixing tank 30. For example, heavy gas oil from fractionator 4 may be used. If distillate recycle is employed in the coking operation, a distillate stream may also be withdrawn from fractionator 4 or a suitable liquid may be obtained from another refinery source. The amount of liquid used in mixing tank 30 is very small compared to the residual oil feed to the coker furnace. Usually not more than a few barrels per hour is required for this purpose. If necessary, heat may be added to the liquid additive mixture leaving mixing tank 30 by providing a small furnace or heater (not shown) in line 34.

Returning now to the drawing, the overhead vapor from coke drums 20 and 20A is passed via lines 24 or 24A to fractionator 4 wherein it is separated into various fractions as previously described. The green coke which is removed from the coke drums through outlets 22 and 22A is further processed (not shown) to produce hexagonal graphite logs which are used as moderators in high temperature, gas-cooled nuclear reactors. The manufacture of such rods involves a series of steps which include calcination, heating to remove volatile hydrocarbons, graphitization and densifying treatment. These steps, which do not perform a part of the invention, are described in detail in Peterson et al. U.S. Pat. No. 3,112,181, which patent is incorporated herein by reference.

As shown in the drawing the residual oil feedstock is fed into a fractionator from which a combined mixture of residual oil and heavy gas oil is withdrawn as feed to the delayed coker. This type of operation is typical of a commercial unit. However, the residual oil can be fed directly to coker furnace 16 and thereafter introduced to the coke drums. In the latter operation the diluent, if used, can be heavy gas oil obtained from the coking operation or another suitable diluent material.

The isotropic coke produced by the process of the invention has excellent quality, as indicated by a low CTE ratio, usually less than about 1.5, and by low sulfur content, usually not more than about 1.6 percent. The CTE can be measured by any of several standard methods. In one method, the coke is crushed and pulverized, dried, and calcined to about 2,400° F. The crushed coke is sized so that about 50 percent passes through a No. 200 U.S. standard sieve. The coke is blended with coal tar pitch binder, and a small amount of lubricant. The mixture is extruded at about 1,500 psi into electrodes of about three-fourths-inch diameter and about 5 inches long. These electrodes are heated slowly up to a temperature of about 850° C. and heat-soaked for two hours. After a slow cool-down period (8–10 hours), the baked electrodes are graphitized at approximately 3000° C. Test pieces are machined from the graphitized electrodes. The coefficient of thermal expansion of the test specimens is then measured in the axial and radial directions over the range of about 30–130° C. heated at a rate of about 2° C. per minute. The CTE ratio, as used herein, is the ratio of the radial CTE to axial CTE of the graphitized electrodes.

When subjected to coking, the mineral oils used in the process of the invention do not alone produce acceptable isotropic products, viz products having a CTE ratio of less than about 1.5. The process offers an advantage over the prior art in that it eliminates the step of airblowing the mineral oil feedstock prior to coking.

The following example illustrates the results obtained in carrying out the process of the invention:

EXAMPLE 1

A non air-blown sweet straight run residual oil having an API gravity of 13.8, a sulfur content of 1.0 weight percent and containing 24.9 percent aromatic carbon atoms was subjected to delayed coking at a temperature of 900° F. and 60 psi for a period of 8 hour. After coking was complete, the green coke was calcined in two stages. In the first stage, the temperature was ramped to 1292° F. for a total calcining time of 4½ hours. In stage two the temperature was ramped to 2600° F. with a total calcining time of 2¼ hours. The calcining was carried out in an atmosphere of nitrogen. Several coking operations were carried out during which various additives were combined with the coking feedstock. The results of the coking and calcining tests are set forth in the table:

TABLE

| Additive | | Calcined Coke | |
|---|---|---|---|
| Type | Wt % | CTE Ratio | Wt % Sulfur |
| $P_4S_3$ | 0 | 2.15 | 1.72 |
| $P_4S_3$ | 0.1 | 1.58 | 1.58 |
| $P_4S_3$ | 0.5 | 1.12 | 1.43 |
| $P_2S_5$ | 0 | 2.15 | 1.72 |
| $P_2S_5$ | 0.1 | 1.30 | 1.46 |
| $P_2S_5$ | 0.5 | 1.20 | 1.46 |
| Sn | | 2.15 | 1.72 |
| Sn | 0.1 | 1.54 | 1.60 |
| Sn | 0.5 | 1.23 | 1.48 |
| P Red | 0 | 2.15 | 1.72 |
| P Red | 0.1 | 1.68 | 1.58 |
| P Red | 0.5 | 1.45 | 1.55 |

It is noted from the data in the table that the calcined coke prepared from the residual oil in the absence of any additives had a CTE ratio well above 1.5. With additive amounts of 0.1 weight percent and 0.5 weight percent coke products having a CTE ratio from 1.1 to 1.68 were obtained.

While certain embodiments and details have been shown for the purpose of illustrating the present invention, it will be apparent to those skilled in the art that various changes and modifications may be made herein without departing from the spirit and/or scope of the invention.

We claim:

1. A process which comprises combining a non-airblown low sulfur heavy aromatic mineral oil which does not produce acceptable isotropic coke when subjected to delayed coking, with an inorganic additive which promotes pyrolysis and which vaporizes during calcining of the coke and thereafter subjecting the combination to delayed cooling to produce acceptable isotropic coke which is subsequently subjected to calcining, wherein the inorganic additive is selected from the group consisting of elements from groups IVA and VA of the Periodic Table and sulfides of such elements, which vaporize during calcining of the coke.

2. The process of claim 1 in which the isotropic coke has a coefficient of thermal expansion ratio of less than about 1.5 and a sulfur content of less than about 1.6 weight percent.

3. The process of claim 2 in which the delayed coking is carried out at a temperature of between about 830° F. and about 950° F., a pressure of between about 15 psig and about 200 psig for about 8 hours to about 100 hours.

4. The process of claim 2 in which the inorganic additive is selected from the group consisting of Sn, As, P, Pb, $P_2S_5$, $P_4S_3$ and $As_2S_5$.

5. The process of claim 4 in which the additive content of the combination is between about 0.1 and about 5.0 weight percent.

6. The process of claim 5 in which the low sulfur heavy aromatic mineral oil is a straight run residual oil.

7. A process which comprises combining a non airblown low sulfur heavy aromatic mineral oil which when subjected to delayed coking produces a coke having a coefficient of thermal expansion ratio of 2.0 or higher, with an inorganic additive selected from the group consisting of elements from groups IVA and VA of the Periodic Table and sulfides of such elements, which vaporize during calcining of the coke, and thereafter subjecting the combination to delayed coking to obtain isotropic coke having a coefficient of expansion ratio below about 1.5 and a sulfur content of less than about 1.6 weight percent, which is subsequently subjected to calcining.

8. The process of claim 7 in which the isotropic coke has a sulfur content of less than about 1.6 weight percent.

9. The process of claim 8 in which the delayed coking is carried out at a temperature of between about 830° F. and about 950° F., a pressure of between about 15 psig and about 200 psig for about 8 hours to about 100 hours.

10. The process of claim 9 in which the additive content of the combination is between about 0.1 and about 5.0 weight percent.

11. A process which comprises combining a non air-blown heavy aromatic mineral oil having a sulfur content below about 2.0 weight percent which when subjected to delayed coking produces a coke having a coefficient of thermal expansion ratio of 2.0 or higher, with an inorganic additive selected from the group consisting of Sn, As, P, Pb, $P_2S_5$, $P_4S_3$ and $As_2S_5$, and thereafter subjecting the combination to delayed coking to produce isotropic coke having a coefficient of expansion ratio below about 1.5 and a sulfur content of less than about 1.6 weight percent.

12. The process of claim 11 in which the isotropic coke has a coefficient of thermal expansion ratio of less than about 1.5 and a sulfur content of less than about 1.6 weight percent.

13. The process of claim 12 in which the delayed coking is carried out at a temperature of between about 830° F. and about 950° F., a pressure of between about 15 psig and about 200 psig for about 8 hours to about 100 hours.

14. The process of claim 13 in which the additive content of the combination is between about 0.1 and about 5.0 weight percent.

15. The process of claim 14 in which the heavy aromatic mineral oil is a straight run residual oil.

* * * * *

UNITED STATES PATENT AND TRADEMARK OFFICE

CERTIFICATE OF CORRECTION

PATENT NO. : 5,160,602

DATED : November 3, 1992

INVENTOR(S) : Lloyd G. Becraft and Edward J. Nanni

It is certified that error appears in the above-identified patent and that said Letters Patent is hereby corrected as shown below:

Column 1, line 11, delete "10".

Column 3, line 52, delete "beutilized" and insert --be utilized--.

Claim 1, column 6, line 36, delete "cooling" and insert --coking--.

Signed and Sealed this

Twenty-sixth Day of October, 1993

*Attest:*

*Attesting Officer*

BRUCE LEHMAN

*Commissioner of Patents and Trademarks*